US006496794B1

(12) United States Patent
Kleider et al.

(10) Patent No.: US 6,496,794 B1
(45) Date of Patent: Dec. 17, 2002

(54) METHOD AND APPARATUS FOR SEAMLESS MULTI-RATE SPEECH CODING

(75) Inventors: John Eric Kleider, Scottsdale, AZ (US); Jeffery Scott Chuprun, Scottsdale, AZ (US); Richard James Pattison, Fountain Hills, AZ (US); Chad Bergstrom, Chandler, AZ (US); Byron Tarver, Chandler, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/447,315

(22) Filed: Nov. 22, 1999

(51) Int. Cl.[7] ..... G10L 21/00
(52) U.S. Cl. ..... 704/201; 704/201; 704/217
(58) Field of Search ..... 704/200, 203, 704/205, 206, 207, 217, 219, 220, 230, 265, 267, 270, 263, 278

(56) References Cited

U.S. PATENT DOCUMENTS

| | | | | | |
|---|---|---|---|---|---|
| 4,464,784 | A | * | 8/1984 | Agnello | 381/61 |
| 4,757,540 | A | * | 7/1988 | Davis | 370/335 |
| 4,864,620 | A | * | 9/1989 | Bialick | 704/207 |
| 5,175,769 | A | * | 12/1992 | Hejna et al. | 704/219 |
| 5,216,744 | A | * | 6/1993 | Alleyne et al. | 704/200 |
| 5,341,432 | A | * | 8/1994 | Suzuki et al. | 704/211 |
| 5,515,375 | A | * | 5/1996 | DeClerck | 126/501 |
| 5,657,420 | A | * | 8/1997 | Jacobs et al. | 375/225 |
| 5,717,823 | A | * | 2/1998 | Kleijn | 704/263 |
| 5,828,994 | A | * | 10/1998 | Covell et al. | 704/211 |
| 5,832,442 | A | * | 11/1998 | Lin et al. | 704/219 |
| 5,940,439 | A | * | 8/1999 | Kleider et al. | 704/220 |
| 6,052,658 | A | * | 4/2000 | Wang et al. | 704/205 |
| 6,330,533 | B2 | * | 12/2001 | Su et al. | 704/211 |
| 2001/0023396 | A1 | * | 9/2001 | Gersho et al. | 704/211 |

OTHER PUBLICATIONS

Dubnowski, JJ, et al., "Variable Rate Coding of Speech," Mar. 1979, The Bell System Technical Journal, vol. 58, No. 3, pp. 577–600.*

Verhelst, W., et al., An overlap–add technique based on waveform similariy for high quality time–scale mmodification of speech, Apr. 1993, 1993 IEEE International Conference on Acoustics, Speech, and Signal Processing, pp. 554–557, vol. 2.*

* cited by examiner

*Primary Examiner*—Vijay Chawan
*Assistant Examiner*—V. Paul Harper
(74) *Attorney, Agent, or Firm*—Daniel K. Nichols

(57) ABSTRACT

A communications system (100) includes a multi-rate source coder (MRSC) (102), a variable size/rate buffer (VSRB) (112), a speech buffer (104), and a buffer control block (106). The variable size/rate buffer (112) includes a source coder bit buffer (SCBB) (114) and an adaptive transmit frame buffer (116). The source coder bit buffer (114) receives speech frames coded at different rates from the multi-rate source coder (102), and deposits an integer or non-integer number of frames in the adaptive transmit frame buffer (ATFB) (116). A receiver includes a seamless rate transition module (SRTM) (308) and an variable buffer (310). The seamless rate transition module (308) correlates speech data previously coded at different rates, and it then truncates or alternatively appends, concatenates, and warps the speech data to remove any annoying artifacts at the rate change boundary.

19 Claims, 5 Drawing Sheets

200

600

800

METHOD AND APPARATUS FOR SEAMLESS MULTI-RATE SPEECH CODING

GOVERNMENT LICENSE RIGHTS

The U.S. Government has a paid-up license in this invention and the right in limited circumstances to require the patent owner to license others on reasonable terms as provided for by the terms of Contract No. DAAL01-96-2-0002 awarded by the U.S. Army.

FIELD OF THE INVENTION

The present invention relates generally to communications systems and, in particular, to multi-rate speech coding systems.

BACKGROUND OF THE INVENTION

Good quality voice services are in high demand, due in part to the emergence of global communication capabilities, such as those provided by cellular systems, satellite systems, landline systems, wireless systems, and combinations thereof. Digital speech coders typically used in these types of systems often operate at fixed rates that utilize a given amount of channel bandwidth. When enough channel bandwidth is available, fixed rate speech coders provide good quality voice services.

The transmission channel medium, however, is often capacity limited or causes excessively high bit error rates. When channel capacity changes, fixed rate coders are often unable to provide synthesized speech at a fixed delay, and they cannot dedicate additional forward error correction bits for protection against the noisy channel. In wireless applications, the channel capacity can change dramatically, and it thus imposes a variable limit on the maximum bit rate that can be passed through the channel.

Variable rate speech coders can reduce the coding rate when channel capacity diminishes, but the quality of speech can suffer. The quality suffers in part because of "artifacts" in the synthesized waveform at the boundary between coding rates. For example, when the variable rate speech coder changes from one coding rate to another, a user may experience a "pop" sound or a silent period due to a discontinuity in the synthesized speech waveform.

A significant need therefore exists for an improved method and apparatus for providing speech coding on a variable bandwidth channel.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

DETAILED DESCRIPTION OF THE DRAWINGS

In the following detailed description, reference is made to the accompanying drawings that show, by way of illustration, specific embodiments in which the invention may be practiced. It is to be understood that other embodiments may be utilized and structural changes may be made without departing from the scope of the present invention.

The method and apparatus of the present invention provide a multi-rate speech coding mechanism that can seamlessly change coding rates "on the fly." Rate change requests can be generated by the communication system, or they can be generated in response to changing channel characteristics. For example, when fading occurs in the channel, the coding rate can be reduced to allow for either additional forward error correction, or a reduction in the modem symbol rate. The multi-rate speech coding mechanism is switchable between different rates that can be requested at any time, and it produces smooth transitions at the switch locations without producing annoying artifacts in the speech.

Figure 1:
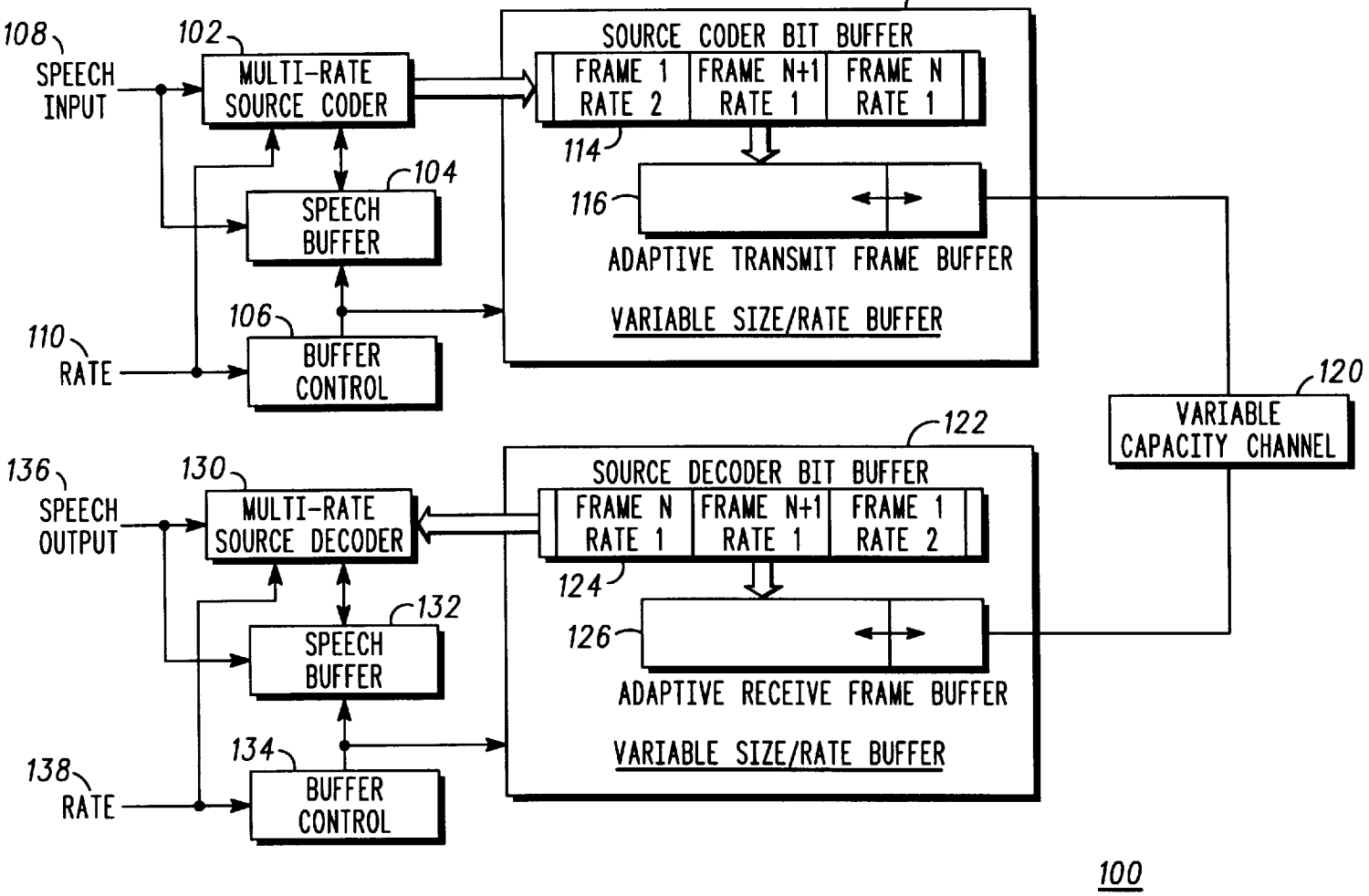
FIG. 1 shows a communications system in accordance with a preferred embodiment of the present invention.

Turning now to the drawings in which like reference characters indicate corresponding elements throughout the several views, attention is first directed to FIG. 1. FIG. 1 shows a communications system in accordance with a preferred embodiment of the present invention. Communications system 100 comprises a transmitter portion, variable capacity channel 120 and a receiver portion. The transmitter portion of communications system 100 includes multi-rate source coder (MRSC) 102, speech buffer 104, buffer control block 106, and variable size/rate buffer (VSRB) 112. The receiver portion includes multi-rate source (de)coder MRSC 130, speech buffer 132, buffer control block 134, and VSRB 122.

MRSC 102 produces "frames" of coded speech. Speech present on speech input node 108 is divided into discrete segments, each segment being one "frame size" in time duration. Frames of coded speech produced by MRSC 102 hold digital information (bits), and the number of bits per frame is a function of the frame size and coding rate. When the coding rate changes, the frame size can change, and the number of bits per frame can change.

The transmitter portion of communications system 100 outputs "blocks" of coded speech to variable capacity channel 120. A block can be an integer number of frames, or a non-integer number of frames. The receiver portion of communications system 100 receives blocks from variable capacity channel 120, and MRSC 130 processes frames of coded speech within the blocks.

MRSC 102 can be any type of multi-rate coder, such as a multi-mode code excited linear predictive (CELP) coder, or a multi-rate multiband excitation (MBE) speech coder. In a preferred embodiment, MRSC 102 is a multi-rate sinusoidal transform coder (MRSTC). The MRSC 102 can also comprise multiple types of speech coders, such as CELP at 9.6 kbps, MBE at 4.8 kbps, sinusoidal transform coder at 2.4 kbps, or the like. The MRSTC is preferably a modular MRSTC that is optimized for each coding rate. Any number of different coding rates can be used; however, in a preferred embodiment, four bit rates are used. They are 9.6 kilobits/second (kb/s), 4.8 kb/s, 2.4 kb/s, and 1.2 kb/s. One advantage of utilizing a modular MRSTC for MRSC 102 is to increase speech quality at each bit rate without a corresponding increase in algorithmic complexity. The interface provides the ability to switch between any of the four rates, at any time, without producing annoying artifacts at the switch locations. The modular MRSTC produces a graceful degradation in speech quality as the rate decreases.

The sinusoidal transform analysis and synthesis blocks can be used at any of the desired rates with slight differences in the algorithm at each rate. One difference is in the parameters used to perform the signal processing; for example, linear predictive (LP) analysis order changes with the rate. The coding/decoding blocks are rate specific, because unique quantization codebooks are used at each rate to produce good speech quality at the lower encoding rates. Table 1 provides a summary of exemplary MRSTC algorithmic details at each of the four rates.

TABLE 1

Multi-rate voice coder parameters.

| Bit Rate (kb/s) | Frame Size (msec) | Bits/ Frame | LFC Order |
|---|---|---|---|
| 1.2 | 40 | 48 | 10 |
| 2.4 | 30 | 72 | 14 |
| 4.8 | 30 | 144 | 16 |
| 9.6 | 25 | 240 | 16 |

MRSC 102 changes the coding rate in response to a rate change request on rate change request node 110. MRSC 102 can be used in different modes, including a network-controlled mode and a channel-controlled mode. In network-controlled mode, MRSC 102 switches between any rate at the request of a network rate control signal on rate change request node 110. In channel-controlled mode, similar switching is provided, but in response to changing channel conditions, as determined by the communication system. For example, in a wireless communication system, long-term fading can cause very low received signal-to-noise ratios, resulting in excessively high bit error rates over long time duration. To reduce the speech distortion due to uncorrected bit errors, the system requests a reduction in the speech coding bit rate. In addition, the system can request an increase in forward error correction bit rate or a reduction in the modem symbol rate, or both.

Buffer control block 106 processes the rate request on rate change request node 110, and it passes the appropriate control parameters to MRSC 102, speech buffer 104, and VSRB 112. In some embodiments, there exists a time delay between receipt of a rate change request by buffer control block 106 and when MRSC 102 changes the coding rate. This is due in part to the time left to finish coding the current speech frame. In some embodiments, this delay can be reduced or eliminated by ignoring the current speech frame, and backing up the appropriate amount in the speech buffer to begin coding at the new rate. In some embodiments, the rate change request is sent to the receiver via a low-bandwidth side information channel. In other embodiments, a separate field carries rate information as part of the transmitted frame structure.

Speech buffer 104 at the transmitter operates slightly differently than speech buffer 132 at the receiver. At the transmitter, speech buffer 104 stores past samples of digitized speech. This helps to smooth the resulting synthesized waveforms during rate changes and also helps to reduce the time delay between a rate change request and when the rate change occurs. Speech buffer 132 at the receiver helps to remove jitter due to variance in data delivery rates.

In some embodiments, speech buffer 104 is not present. In these embodiments, speech data is not buffered prior to coding. When MRSC 102 receives a rate change request, a time delay may exist between the time the rate change request is received and the time at which the rate change takes place.

VSRB 112 includes source coder bit buffer (SCBB) 114 and adaptive transmit frame buffer (ATFB) 116. One function of ATFB 116 is to allow variable block sizes of bits to be transmitted. This aids in reducing end-to-end delay of digital voice data transmitted over the Internet, and it supports adaptive-rate modulation for transmission of digital voice data over wireless channels.

SCBB 114 receives coded frames from MRSC 102 and transfers them to ATFB 116 for transmission. SCBB 114 can receive consecutive frames coded at different rates. For example, SCBB 114 is shown in FIG. 1 as having three frames therein. Two frames (frames N and N+1) are coded at an "old" rate (rate 1), and one frame (frame 1) is coded at a "new" rate (rate 2).

In a preferred embodiment, the block size that is transmitted is set to be directly proportional to the rate of MRSC 102. The ATFB frame delivery rate is then proportional to the time taken to fill SCBB 114 with an integer number of speech frames, $I_f$ at the current source coding rate. The frame delivery rate is not restricted to a fixed value, in part because correct timing coordination is selected between ATFB 116 and SCBB 114. When $I_f$ is reached, buffer control block 106 sends out a control signal indicating it is time to transfer $I_f$ frames to ATFB 116 and to output the block of bits from VSRB 112.

The data flow at the receiver is in general the reverse of that at the transmitter. VSRB 122 receives blocks of bits from variable capacity channel 120. The blocks are received into adaptive receive frame buffer (ARFB) 126. When an appropriate number of blocks has been received, the blocks are transferred to source decoder bit buffer (SDBB) 124. Frames of coded speech are sent from SDBB 124 to MRSC 130 for decoding. Frames of decoded speech are sent from MRSC 130 to speech buffer 132, from which speech data is output on speech output node 136. Speech buffer 132 can include a seamless rate transition module (SRTM) and variable buffer as explained more fully below with reference to FIG. 3.

One advantage of using VSRB 112 can be seen by showing the end-to-end delay compared to a fixed size/rate buffering (FSRB) approach, which is typically used for fixed-symbol rate wireless systems. For the purposes of this comparison, an assumption is made that for the FSRB the transmit frame buffer holds a fixed number of bits, the frame transmit rate is fixed, but storage variance is allowed in the number and size of source coder frames (same as the VSRB). Also for purposes of this comparison, an assumption is made that the output bit rate of the VSRB is equal to the source coder bit rate. The total delay, $t_{dv}$, for the VSRB can be written as $$t_{dv}=t_{sw}+t_{fsr}=(t_{fsc}-t_{req})+t_{fsr}(\text{msec}), \quad (1)$$

where $t_{fsc}$ is the vocoder frame size at the current rate, $t_{fsr}$ is the vocoder frame size at the new rate, $t_{req}$ is the time of the "rate change request," relative to the end of the current frame boundary, and $t_{sw}$ is the time difference between $t_{fsc}$ and $t_{req}$. We assume that $t_{req}$ occurs such that it is uniformly distributed within a frame of length equal to $t_{fsc}$. The total delay, $t_{df}$, for the FSRB is $$t_{df}=t_{sw}+t_{buf}(\text{msec}), \quad (2)$$

where $t_{sw}$ is as defined above with a multiplication factor of $B_t/B_{vo}$, which is a modifier that represents the number of vocoder frames taken to fill transmit frame buffer, $B_{vo}$ is the vocoder frame size at the current rate (bits per frame), and $t_{buf}$ is the time required to fill the transmit frame buffer. $t_{buf}$ can be expressed as $$t_{buf}=(B_t/B_v)t_{fsr}(\text{msec}), \quad (3)$$

where $B_t$ is the transmit frame buffer size (bits per frame), $B_v$ is the vocoder frame size at the new rate (also in bits per frame). In the embodiment corresponding to the above equations, the transmit frame buffer holds an integer number of vocoder speech frames. In other embodiments, the transmit frame buffer holds a non-integer number of vocoder speech frames.

Figure 2:
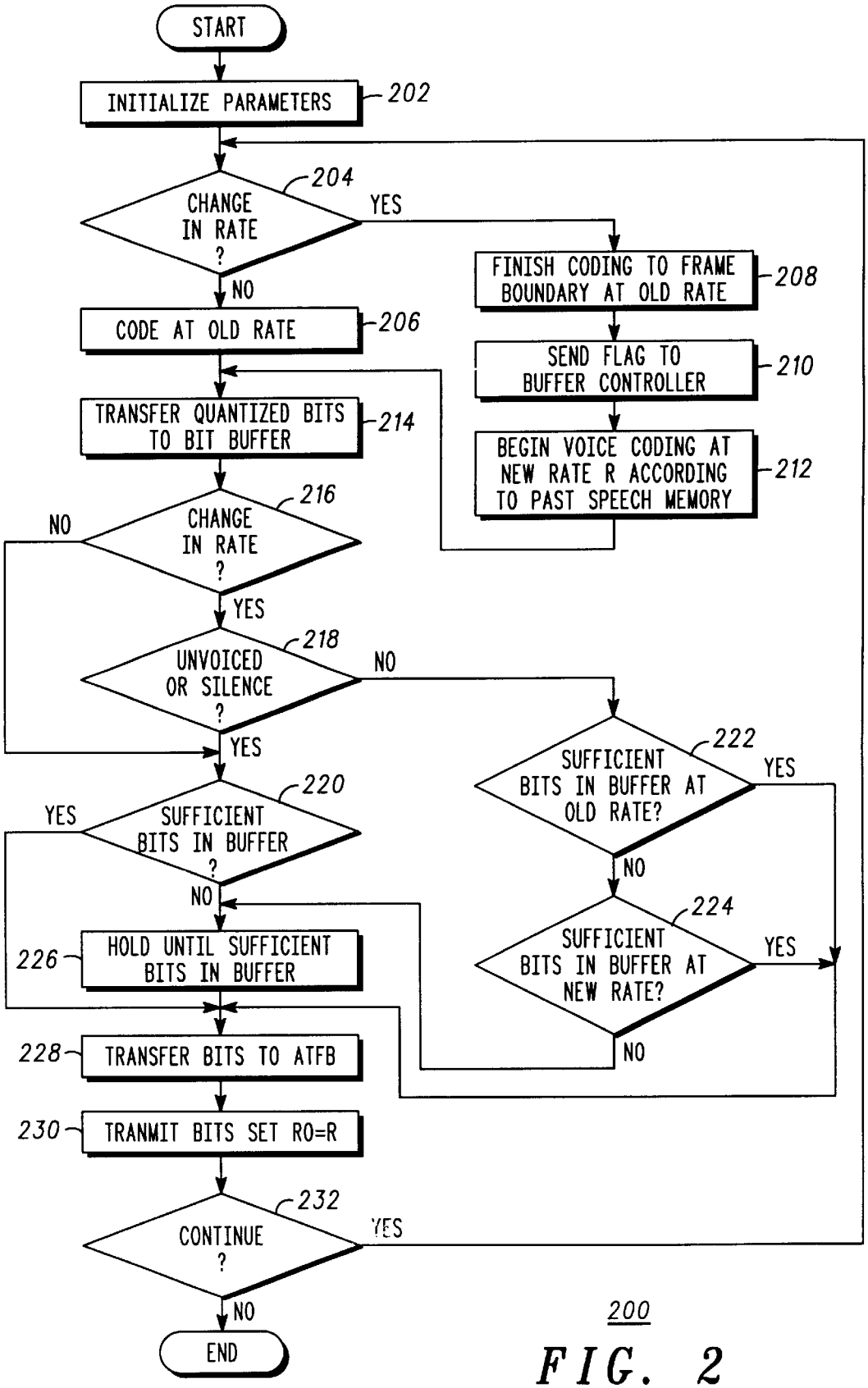
FIG. 2 is a flowchart of a method for operating a variable size/rate buffer in accordance with a preferred embodiment of the present invention.

FIG. 2 is a flowchart of a method for operating a variable size/rate buffer in accordance with a preferred embodiment of the present invention. Method 200 begins in block 202 where the VSRB is initialized on system power up. Initialized parameters include: previous speech encoding bit rate request value ($R_0$); new speech encoding bit rate request value (R); the size (number) of bits in the ATFB ($B_{ATFS}$); the previous $B_{ATFS}$ or ($B_{ATFS0}$); the number of speech frames utilized to create the first frame of speech at the new rate (HIST); and bits previously stored in the bit buffer ($B_0$).

The encoding rate is set to R, and then in block 204, a determination is made whether R is equal to the old encoding rate. If R is equal to the old rate, then there is no change in rate, and coding continues at the same rate in block 206. If R is not equal to the old rate, then there is a change in rate, and method 200 transitions from block 204 to block 208 where the current frame is finished coding at the old rate. In block 210, a buffer control flag ($F_R$), indicating the rate change location in the bit buffer, is sent to the buffer controller, such as buffer control block 106 (FIG. 1). $F_R$ can mark the location of the end of the last frame coded at the old rate, or it can mark the location of the beginning of the first frame coded at the new rate. In block 212, voice coding at rate R begins HIST speech frames back in time by utilizing data in the speech buffer and sending the voicing probability (VP) to a voicing memory.

From either block 206 or block 212, method 200 transitions to block 214 where the quantized bits are sent to the bit buffer, and $B_{ATFS}$ and $F_R$ are read from the buffer controller. In block 216, a determination is made whether there is a change in rate. If there is no change in rate, then method 200 transitions to block 220 where a determination is made whether the number of bits in the bit buffer is sufficient to be transmitted at the old encoding rate, e.g., is $B(F_R)\geqq B_{ATFS0}$ ? If the number of bits in the bit buffer is not sufficient, then method 200 transitions to block 226 where it remains until sufficient bits exist in the buffer. Otherwise, method 200 transitions to block 228 where $B_{ATFS}$ bits are transferred from the bit buffer to the ATFB.

If, in block 216, it is determined that a change in rate has occurred, method 200 transitions to block 218 where a determination is made whether the current region of speech is unvoiced or silent, e.g., is VP (voicing probability)<1/4? Known mechanisms for determining if speech in the current frame is voiced or unvoiced can be utilized. If true (unvoiced or silent region), it is determined whether the number of bits in the bit buffer is sufficient to be transmitted, e.g., is ($B(F_R)\geqq B_{ATFS0}$) at the current rate in block 220. If true, $B_{ATFS}$ bits are transferred to the ATFB in block 228, and the bits are transmitted, R is set to $R_0$, and $B_{ATFS0}$ is set to $B_{ATFS}$ in block 230. If false, encoding is continued in block 226 until there are enough bits in the bit buffer for transfer, e.g., until $B(F_R)\geqq B_{ATFS}$. Method 200 then continues in block 228 as before.

If, in block 218, it is determined that the current region of speech is a voiced region (i.e. VP>1/4), a smooth transition without artifacts is provided in the transitioned speech region. Method 200 proceeds by making the determination of how many bits are in the bit buffer, e.g., is $B(F_R-B_{MAX})\geqq B_{ATFS0}$ at the old rate in block 222 or at the new rate in block 224. If true, $B_{ATFS0}$ bits are transferred to the ATFB in block 228 (some leftover from the previous rate), the bits are transmitted, R is set to $R_0$, and $B_{ATFS0}$ is set to $B_{ATFS}$ in block 230. If false, encoding is continued in block 226 until there are enough bits in the bit buffer for transfer, e.g., until $B(F_R)>B_{ATFS}$. Method 200 continues when $B_{ATFS}$ bits are transferred to the ATFB in block 228, and the bits are transmitted, R is set to $R_0$, and $B_{ATFS0}$ is set to $B_{ATFS}$ in block 230. Method 200 continues by transitioning to block 204, unless the communication is terminated or there is no more speech to encode.

Method 200 represents a particular embodiment where voice coding for the current frame is finished at $R_0$ if the rate change request occurs prior to the end of the current frame. In other embodiments, the last frame at the old rate is dropped, and past digitized speech samples are used. The past digitized samples are coded at the new rate, and the transitions are sewn together using one frame of past speech coded at the new rate.

Figure 3:
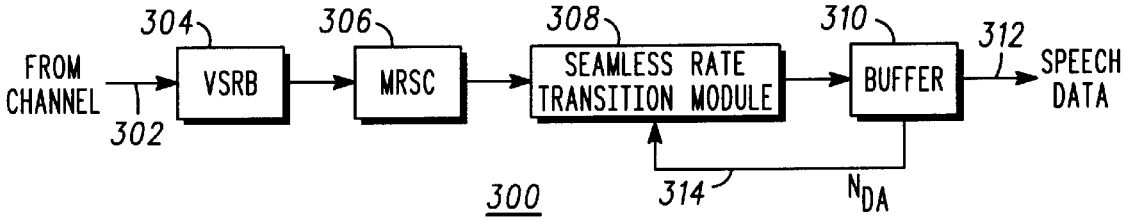
FIG. 3 shows a portion of a receiver in accordance with a preferred embodiment of the present invention.

FIG. 3 shows a portion of a receiver in accordance with a preferred embodiment of the present invention. Receiver 300 includes VSRB 304, MRSC 306, seamless rate transition module (SRTM) 308, and variable buffer 310. VSRB 304 can be a VSRB such as VSRB 122 (FIG. 1). MRSC 306 is a multi-rate (de)coder, such as MRSC 130 (FIG. 1). SRTM 308 and variable buffer 310 work together to provide a "seamless" transition from speech data that was coded at one rate to speech data that was coded at another rate. Speech data received at SRTM 308 is synthesized by MRSC 306. When synthesized speech data that was previously coded at one rate is concatenated with synthesized speech data that was previously coded at another rate, a discontinuity and annoying artifacts in the resultant speech waveform can result. SRTM 308 and variable buffer 310 operate together to remove discontinuities and annoying artifacts.

Figure 4:
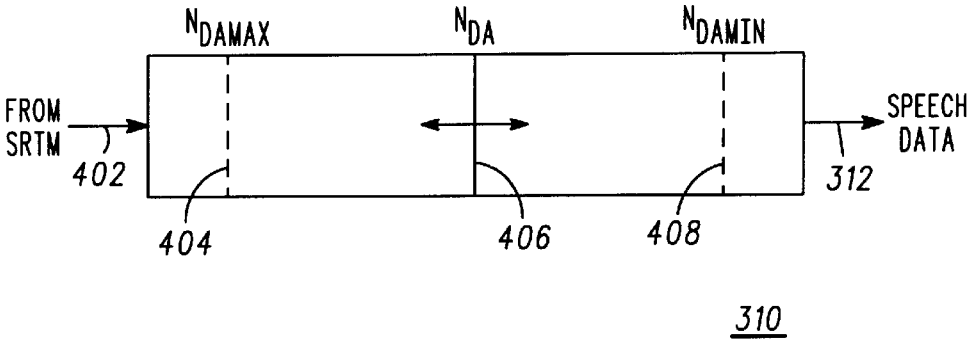
FIG. 4 shows a variable buffer in accordance with a preferred embodiment of the present invention.

FIG. 4 shows a variable buffer in accordance with a preferred embodiment of the present invention. Variable buffer 310 can hold a variable number of speech samples. The current number of samples in variable buffer 310 is denoted by the value $N_{DA}$. $N_{DA}$ 406 can vary between $N_{DAMIN}$ 408 and $N_{DAMAX}$ 404 while supplying a steady stream of speech data on node 312. It is desirable to supply a steady stream of speech data in part because if variable buffer 310 is allowed to underflow, the speech data on node 312 will stop and if the speech data is being sent to a digital-to-analog (D/A) converter, a discontinuity will result. It is also desirable to not let variable buffer 310 overflow, in part because speech data will be lost.

Variable buffer 310 receives speech data from SRTM 308 on node 402. When $N_{DA}$ 406 is approaching $N_{DAMIN}$, it may be desirable to expand, or "warp," the speech data on node 402 such that the speech data will take up more room in variable buffer 310. When warping speech data, a "warping factor" can be found that determines the amount of warping applied to speech data. In addition, if $N_{DA}$ 406 is approaching $N_{DAMAX}$, it may be desirable to compress, or "warp, " the speech data on node 402 such that the speech data will take up less room in variable buffer 310.

Figure 5:
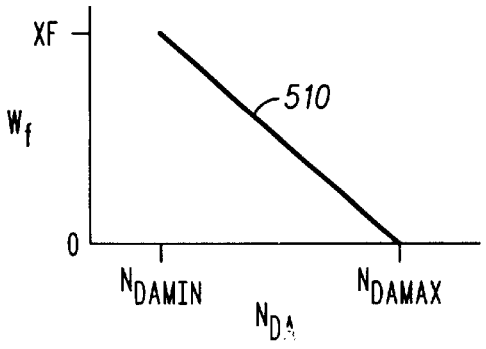
FIG. 5 shows a warping factor function in accordance with a preferred embodiment of the present invention.

FIG. 5 shows a warping factor function in accordance with a preferred embodiment of the present invention. Warping factor ($W_f$) can take on values ranging from zero to the value of the expansion factor (XF). When $N_{DA}$ is equal to $N_{DAMAX}$, $W_f$ is equal to zero, signifying no expansion. When $N_{DA}$ is equal to $N_{DAMIN}$, $W_f$ is equal to XF, signifying full expansion. FIG. 5 shows a linear warping factor for one embodiment of the invention. In other embodiments, the warping factor is a non-linear function of the number of speech samples. In these embodiments, the warping factor exhibits a curved shape rather than a straight line as shown in FIG. 5. In the embodiment shown in FIG. 5, the warping factor can be found as:

$$W_f = XF*(1-[N_{DA}-N_{DAMIN}]/[N_{DAMAX}-N_{DAMIN}]) \quad (4)$$

Figure 6:
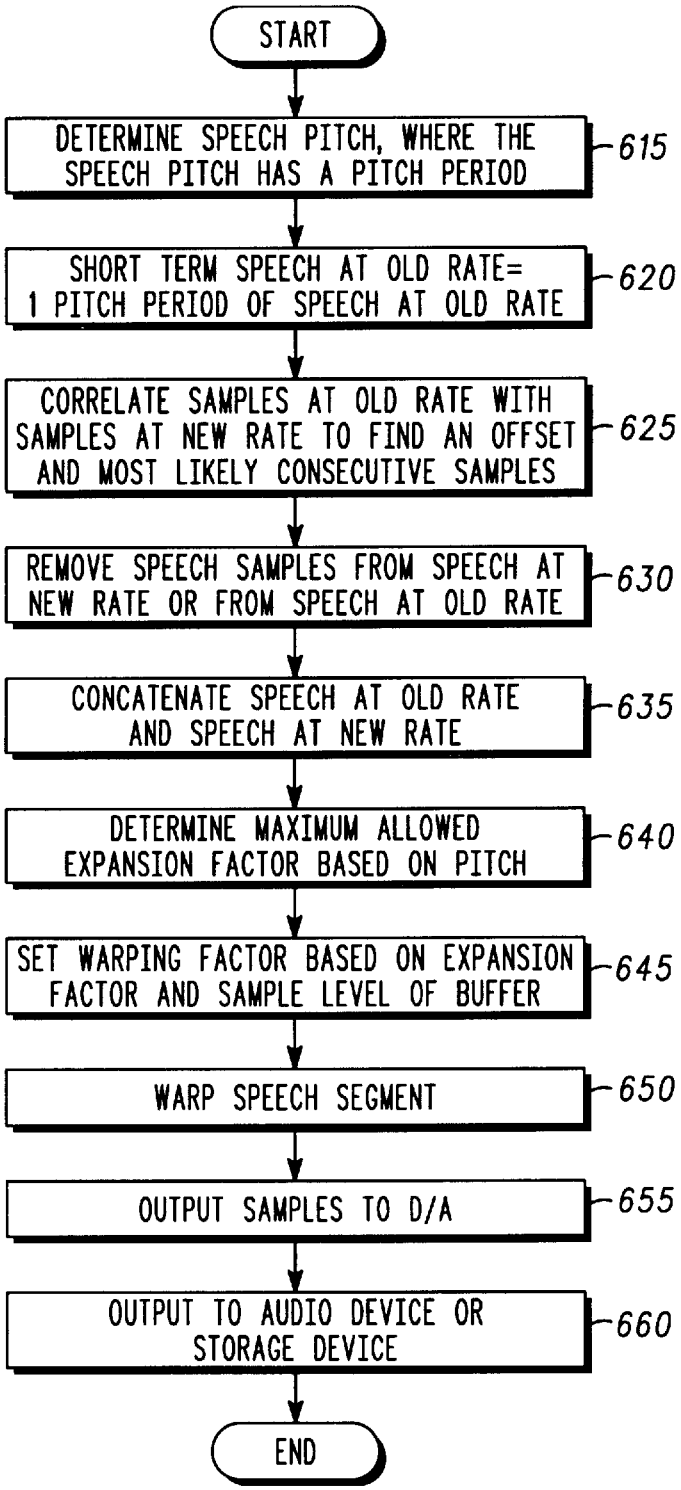
FIG. 6 is a flowchart of a method for operating a seamless rate transition module in accordance with a preferred embodiment of the present invention.

FIG. 6 is a flowchart of a method for operating a seamless rate transition module (SRTM) in accordance with a preferred embodiment of the present invention. Method 600 is invoked when frames received by the SRTM are coded at different rates. Method 600 serves to seamlessly transition between two different rates of synthesized speech that may or may not be pitch synchronous, or that exhibit good likeness properties when audibly heard in succession. When merged by method 600, the speech does not exhibit annoying artifacts. In block 615, the speech pitch is determined, where the speech pitch has a period (P) associated therewith. Because the old rate is likely to have the most stable speech parameters (due to it having been run for some period of time longer than the coder at the new rate), the speech pitch is determined at the old rate. In a preferred embodiment, the speech pitch is determined using an absolute magnitude difference function (AMDF) on the last frame of speech at the old rate; however, any appropriate pitch determination method can be utilized.

In block 620, a short-term speech segment is then assigned from the old rate's speech and is based on the determined pitch. The number of speech samples from the old rate that are assigned to the short-term sequence is equal to the last sample minus the pitch period (P), in samples, or (N−P to N) samples of the last rate's speech. In addition, a short-term speech segment is assigned from the new rate's speech, and the number of samples is equivalent to the first frame of speech samples at the new rate.

In block 625, the short-term speech samples from the old and new rates are correlated to determine an offset at which the short-term speech samples are most alike. A correlation matrix is formed, and the best value of likeness is found at an offset value where the correlation is at a peak. This represents the offset, or relative shift, in pitch likeness, where the old and new speech segments most likely overlap.

In block 630, speech samples are removed from either of the short-term sequences. The area of overlap in the speech segments is removed so that redundant data is not present. For example, a portion of the old rate speech can be removed from one short-term sequence, or a portion of the new rate speech can be removed from the other short-term sequence. In block 635, the two short term sequences are concatenated.

A vector variable is used to store the concatenated short term speech samples. If speech was removed due to the operation in block 630, then the resulting speech is to be warped (or stretched), so that the concatenated speech length in time equals the amount before any samples were removed. This process is performed so that no perceptual artifacts are audible to the human ear. A table of warping percentages exists such that the expansion factor versus pitch and length of speech can be determined. In block 640, the expansion factor (XF) is determined based on the expansion percentage (X%) and the pitch (P) as XF=X%*P.

In block 645, the warping factor ($W_f$) is set based on the expansion factor and the sample level of the buffer as shown in FIG. 5. The number of samples $N_{DA}$ is read from the variable buffer, and $W_f$, is determined as discussed above. In block 650, the speech segment is warped; in block 655, the samples are output to the D/A; and in block 660, the D/A output is sent to an audio device or a storage device. An exemplary warping function is shown in the pseudo-code that follows:

```
//      TIME_WARP warps the signal x to be stretched in time.
//
//      SYNTAX:    Y = TIME_WARP(X, N2, FS, TYPE);
//      INPUTS:
//        X = input signal to be stretched, a vector.
//        N2 = number of sample points in desired output Y.
//        FS = sampling frequency of the input signal Y.
//        TYPE = type of stretching/compressing function
//              =0 → linear
//              =1 → bartlett stretch
//              =2 → blackman
//              =3 → boxcar (no stretch)
//              =4 → hamming
//              =5 → hanning
//              =6 → kaiser (beta = 1)
//              =7 → tiang
//
//      X is computed at a constant interval T = 1/fs
//      compute window where, dw(n) = f(n) = window(n)
        (i.e., [dw(1), dw(2),
          . . . dw(N)] = [f(1), f(2), . . . f(N)]) where N is
          the length of X.
//      Note: sum(dw(n))*c = n2 − N,
        where we assume we are always stretching X, so
          n2 > M, and c is a normalization constant.
//      c = (n2 − N)/sum(dw(n))
//      dw = c*dw
//      n_new = 1 + dw(n); n = 1, 2, 3, . . . N.
//      Note: N*T goes out to end of X in time. n2*T goes
          out to the end of Y in time, and so
          (n2 − N)*T is the
          amount X is stretched to get Y.
//      Find new indexes of warped X
//      for I = 1:N
//        if I == 1;
//              ns(I) = n_new(I);
//        else
//              ns(I) = ns(I − 1) + n_new(I)
//        end
//      end
```

Figure 7:
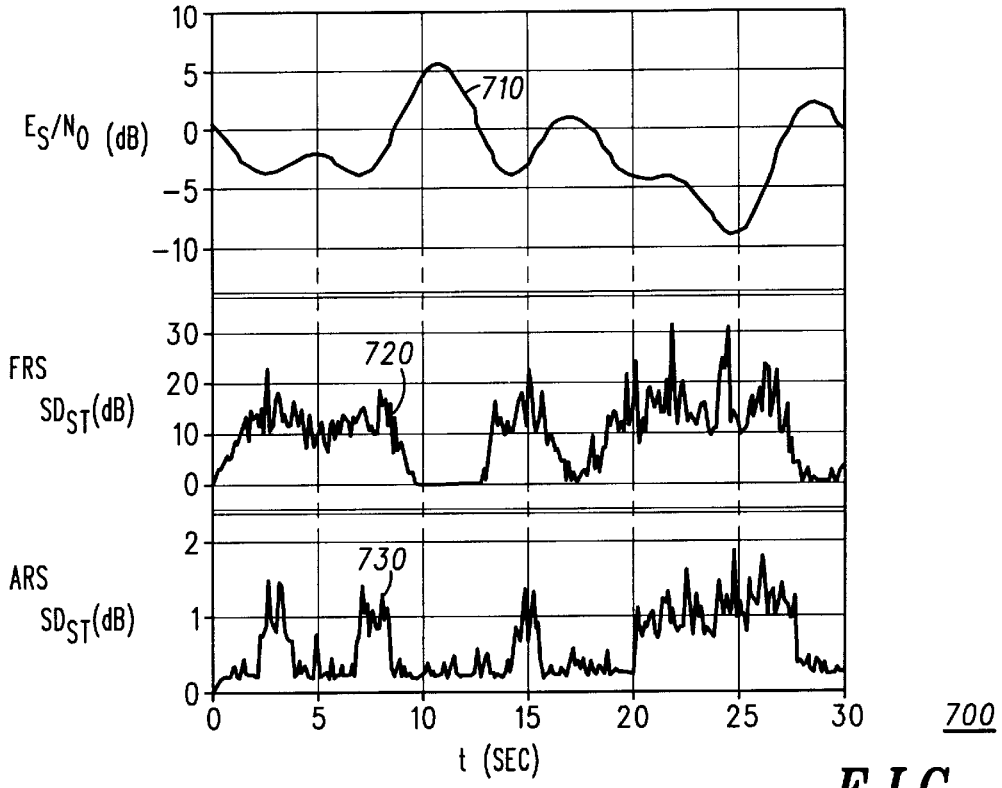
FIG. 7 is a graph of speech distortion waveforms.

FIG. 7 is a graph of speech distortion waveforms. Speech spectral distortion (SD), a performance metric of speech, is measured at the receiver. The SD of the adaptive-rate system (ARS) 730 and the SD of a fixed-rate system (FRS) 720 are shown. In this example, the FRS operates at a symbol rate of 19.2 kilosymbols/sec (ks/s), a MRSTC vocoder rate of 9.6 kb/s, with the same channel coding as utilized in the adaptive-rate system. The received signal-to-noise ratio (SNR) 710 versus time characteristic of the channel is shown in FIG. 7 for a fixed-rate transmitter. Note that for the adaptive-rate system, the received SNR can be written as $E_s/N_o=(C/N_o)(1/R_s)$, where C is the average received power, $N_o$ is the noise spectral density, $R_s$ is the modem symbol rate, and the transmitter power is fixed.

For both systems, the short-time SD, $SD_{st}$, is averaged over a 3-to-5 frame window of a 30 second speech sequence. The adaptive-rate system is implemented utilizing rate ½ channel coding, modem rates of 19.2/9.6/4.8/2.4 ks/s, and MRSTC rates of 9.6/4.8/2.4/1.2 kb/s. FIG. 7 shows the ARS speech quality to be superior to that of the FRS. Informal listening tests confirmed a large improvement in ARS speech quality compared to the FRS. The results in FIG. 7 show that the increase in SD at low values of $E_s/N_o$ is due in part to a large number of bit errors entering the vocoder, and it is much greater than the increase in SD due to lower source encoding rates in the MRSTC. An increase in $C/N_o$ system operating range, of greater than 9 dB, can then be achieved with the ARS, given that the FRS degrades rapidly below 0 dB $E_s/N_o$.SD for both systems, averaged over the 30-second sequence, was 9.5 dB and 0.6 dB, respectively.

Figure 8:
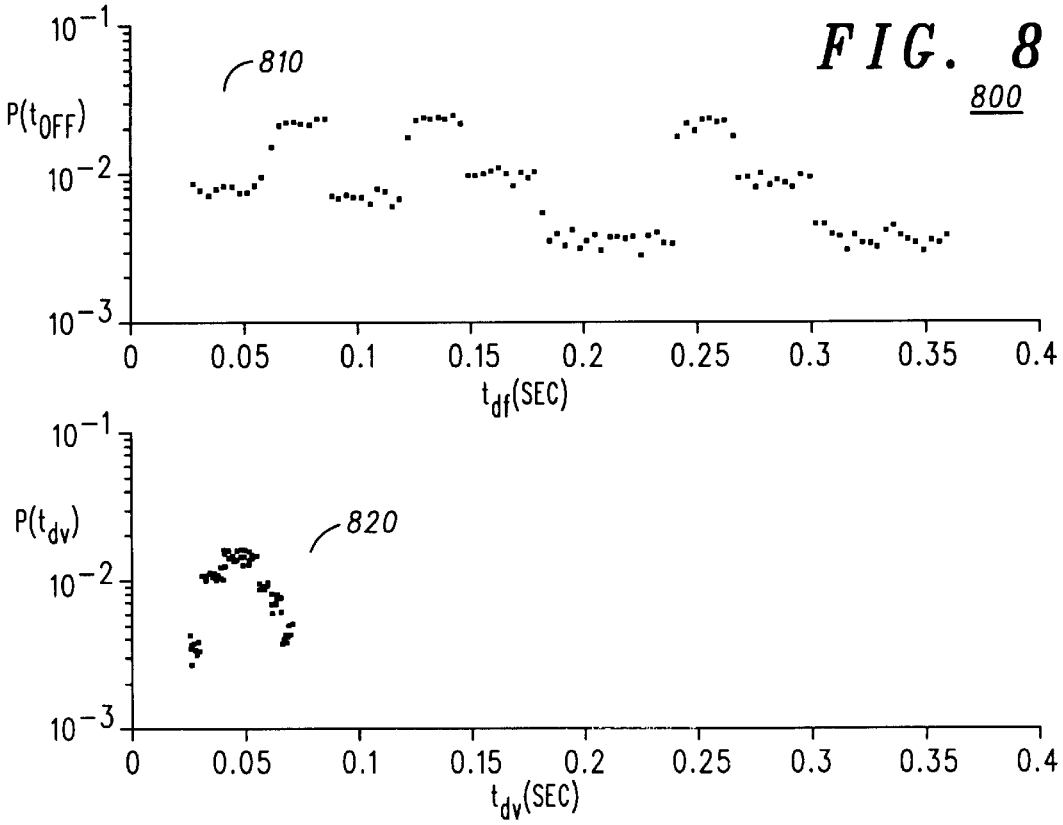
FIG. 8 is a graph of delay probabilities.

FIG. 8 is a graph of delay probabilities. An important consideration of a multi-rate vocoder is the algorithmic delay incurred when switching through a wide range of bit rates. To demonstrate the effectiveness of the VSRB method compared to a FSRB approach, a simulation has been performed modeling the delay probabilities, $P(t_{df})$ and $P(t_{dv})$. The simulation tested the switching algorithm over 50 k independent switch requests. For FSRB, $B_t$ is fixed, with a size which is limited to an integer multiple of the vocoder frame size in bits. This means that no data is available at the output until the integer number is reached. For example, if $B_t$ is 400 bits and $B_v$ is 100 bits, then it does not output data until 4 frames have been stored in the SCBB. FIG. 8 shows the delay probability simulation results. The VSRB system has substantially less delay than the FSRB system.

In summary, the method and apparatus of the present invention provide a seamless rate transition mechanism in a multi-rate speech system. While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

What is claimed is:

1. A method of coupling a first set of speech data with a second set of speech data comprising:

removing a portion of the second set of speech data to create a second subset of speech data;

concatenating the first set of speech data with the second subset of speech data to produce a concatenated set of data;

warping the concatenated set of data to create a warped concatenated set of data; and sending the warped concatenated set of data to a digital-to-analog (D/A) converter buffer having a number of samples included therein.

2. The method of claim 1 wherein:

the first set of speech data has a first length in time;

the second set of speech data has a second length in time; and the warping creates the warped concatenated set of data having a third length in time substantially equal to the sum of the first length in time and the second length in time.

3. The method of claim 1 wherein the first set of speech data comprises a non-integer number of first decoded frames having been previously coded at a first rate, and the second set of speech data comprises a single second decoded frame having previously been coded at a second rate.

4. The method of claim 3 wherein the first set of speech data represents speech having a pitch, the method further comprising:

determining the pitch of the speech represented by the first set of speech data, wherein the pitch has a period associated therewith; and setting a size of the first set of speech data substantially equal to the period of the pitch.

5. The method of claim 1 wherein removing a portion of the second set of speech data comprises:

correlating the first set of speech data with the second set of speech data to determine an offset;

determining a size of the portion of the second set of speech data as a function of the offset; and removing the portion of the second set of speech data to create the second subset of speech data.

6. The method of claim 1 wherein the warping is a function of the number of samples included in the D/A buffer.

7. A method of combining two speech waveforms, the method comprising:

correlating the two speech waveforms to produce an offset;

reducing a size of one of the two speech waveforms by a number of samples substantially equal to the offset;

concatenating the two speech waveforms; and wherein the two speech waveforms comprise a first speech waveform decoded from at least one frame having been previously coded at a first rate.

8. The method of claim 7 wherein the two speech waveforms further comprises a second speech waveform decoded from at least one frame having been previously coded at a second rate different from the first rate.

9. The method of claim 8 further comprising:

prior to correlating, determining a period of a pitch of the first speech waveform;

prior to correlating, truncating the first speech waveform such that a size of the first speech waveform is substantially equal to the period of the pitch of the first speech waveform; and prior to correlating, truncating the second speech waveform such that a size of the second speech waveform is substantially equal to a size of one of the at least one frame having been previously coded at a second rate.

10. The method of claim 9 wherein reducing a size of one of the two speech waveforms comprises reducing the size of the first speech waveform.

11. The method of claim 9 wherein reducing a size of one of the two speech waveforms comprises reducing the size of the second speech waveform.

12. The method of claim 7 further comprising stretching the two speech waveforms to compensate for the size of one of the two speech waveforms being reduced.

13. In a speech encoding system that encodes speech in a plurality of frames including a first frame and a second frame, each of the plurality of frames having a coding rate assigned thereto, a method of adaptively changing from a first coding rate to a second coding rate, the method comprising:

receiving a rate change request during encoding of the first frame at a first coding rate;

finishing encoding the first frame at the first coding rate;

encoding at least a portion of the first frame at the second coding rate; and encoding the second frame at a second coding rate.

14. The method of claim 13 further comprising:

storing a plurality of speech samples in a speech buffer; and marking a location within the speech buffer denoting an end of the first frame.

15. The method of claim 13 further comprising:

storing a plurality of speech samples in a speech buffer; and marking a location within the speech buffer denoting a beginning of the second frame.

16. A transmitter that includes an adaptive frame rate buffer, the adaptive frame rate buffer comprising:

a source coder bit buffer configured to receive a plurality of frames of coded speech from a multi-rate source coder;

an adaptive transmit frame buffer configured to receive an integer or non-integer number of the plurality of frames from the source coder bit buffer;

the multi-rate source coder configured to code the plurality of frames of coded speech;

a speech buffer coupled to the multi-rate source coder, the speech buffer being configured to hold past samples of speech data; and wherein the multi-rate coder is further configured to utilize the past samples of speech data when a rate change request is received.

17. A receiver comprising:

a seamless rate transition module having an input node upon which frames of decoded speech are received; and a variable buffer having an input coupled to an output of the seamless rate transition module, the variable buffer having a number of speech samples included therein;

wherein the seamless rate transition module is configured to deposit a variable number of speech samples in the variable buffer, the variable number of speech samples being a function of the number of speech samples in the variable buffer.

18. The receiver of claim 17 further comprising a multi-rate source decoder having an output node coupled to the input node of the seamless rate transition module.

19. The receiver of claim 18 further comprising a variable size rate buffer having an output node coupled to an input node of the multi-rate source decoder.

* * * * *